US005238015A

United States Patent [19]

Gretzmacher et al.

[11] Patent Number: 5,238,015

[45] Date of Patent: Aug. 24, 1993

[54] FOLDABLE DUMMY OBJECT FOR CAMOUFLAGE PURPOSES

[76] Inventors: Floris Gretzmacher, K. Ebersd. Str 222, Vienna A-1110; Gerhard Patzak, A. Begen. Str. 2d, Vienna A-1140, both of Austria

[21] Appl. No.: 646,639

[22] PCT Filed: May 11, 1990

[86] PCT No.: PCT/AT90/00044

§ 371 Date: Mar. 20, 1990

§ 102(e) Date: Mar. 20, 1990

[87] PCT Pub. No.: WO90/15301

PCT Pub. Date: Dec. 13, 1990

[51] Int. Cl.[5] ..... E04H 15/40

[52] U.S. Cl. ..... 135/102; 135/114; 135/112; 52/108; 403/4; 403/84

[58] Field of Search ..... 135/118; 52/108; 405/4, 405/84, 101

[56] References Cited

U.S. PATENT DOCUMENTS

| | | | |
|---|---|---|---|
| 947,675 | 5/1910 | Carter | 135/118 |
| 3,203,285 | 8/1965 | Schmidt | 403/4 |
| 3,925,943 | 12/1975 | Petrie | 52/108 |
| 4,108,191 | 8/1978 | Merriam | 135/15.1 |
| 4,151,840 | 5/1979 | Barrington | 52/108 |
| 4,311,159 | 1/1982 | Wunderlich | 52/108 |
| 4,611,946 | 9/1986 | Gebelias | 52/108 |
| 4,887,397 | 12/1989 | Peterson | 52/108 |
| 4,958,474 | 9/1990 | Adams | 52/108 |

FOREIGN PATENT DOCUMENTS

| | | |
|---|---|---|
| 678154 | 2/1978 | U.S.S.R. . |
| 1631142 | 2/1991 | U.S.S.R. . |

*Primary Examiner*—Henry E. Raduazo
*Attorney, Agent, or Firm*—Henry M. Feiereisen

[57] ABSTRACT

A foldable dummy object for military camouflage purposes consists of at least three deformable rods (2) which meet at a common point (1) at which they are mutually connected. When the dummy object is deployed, the rods assume and retain the shape of irregular three-dimensional curves, forming an outer rod assembly which can be placed appropriately on the object to be camouflaged, including its corners and edges. The rod assembly comprises a camouflage net which constitutes the definitive outer envelope of the dummy object and also determines its shape. The dummy object is easy to assemble and disassemble and can be trimmed in a known manner with any type of camouflage material. The claim relates to the basic idea and various embodiments.

20 Claims, 1 Drawing Sheet

FOLDABLE DUMMY OBJECT FOR CAMOUFLAGE PURPOSES

BACKGROUND OF THE INVENTION

The invention refers to a camouflage device in form of foldable irregular dummy objects which are distributed upon and attached to an object to be camouflaged, for preventing identification of the object by the naked eye, optical sensors or computer-aided optical sensors.

Known devices of this kind include support structures with a camouflage netting which can be attached to the military object or which can be tilted to assume the intended position (DE 3501611 A1 and DE 2558371 C2, CH 594867). Although easily identifiable contours of the military object become obscured, the overall dimension of the object to be camouflaged significantly increases. Also, the camouflage netting sags wherever it is not supported, resulting in concave surfaces which do not exist in nature. Whenever these concave surfaces exhibit any gloss (or shimmer), a focusing in focal points at greater distances of the object to be camouflaged can be encountered (in accordance with the principle of a concave mirror). A sagging of larger areas can only slightly be reduced by extending the ends of the support structures of the camouflage netting by means of conventional dish-shaped support elements or by specially designed additional rod assemblies (U.S. Pat. No. 4,441,518). Objects of great dimensions (e.g. trucks or artillery pieces), usually require large areas of same material (camouflage netting) which include further elements like branches, twigs, or the like to achieve a sufficient level of camouflage.

For certain specific objects, like artillery pieces, devices are available that can either cover the artillery piece or be opened to expose it (CH 606972). Such devices yield three-dimensional objects which are enveloped by the camouflage netting; however, since their design is greatly dependent on the regular shape of the military object, the selection of shapes for these camouflage nettings is limited. When opened, this device is less effective for camouflage than in its closed position.

SUMMARY OF THE INVENTION

It is an object of the present invention to provide an improved camouflage device which can be swiftly attached and detached and attains a minimum increase in surface and volume of the military object while yet considerably reducing the visibility thereof.

This object and others which will become apparent hereinafter is attained in accordance with the present invention by providing at least three deformable rod structures, with their one ends joined together, and with their other free ends being adapted for placement upon the object to be camouflaged so as to define an outer frame of irregular three-dimensional curves which is coverable by a camouflage netting to display the envelope and thus the configuration of the object and which is positioned over the corners and edges of the object and has sufficient inherent stiffness or is suitably stiffened through tension in direction towards the placement of the frame. The free ends of the frame are attached to the object at predetermined distances from each other and held in place by friction, strutting or by means of an additional support which is connected to the free ends.

Through the provision of such a frame, the camouflage device can be rapidly and reproducibly assembled and disassembled.

The camouflage device according to the invention permits utilization not only of contrasts of color and brightness, but also of natural shades caused by the dummy objects in the visible spectral range and reflective properties in the other ranges usable for optical purposes (e.g. ultra-violet, infra-red, microwaves, and millimeter waves).

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
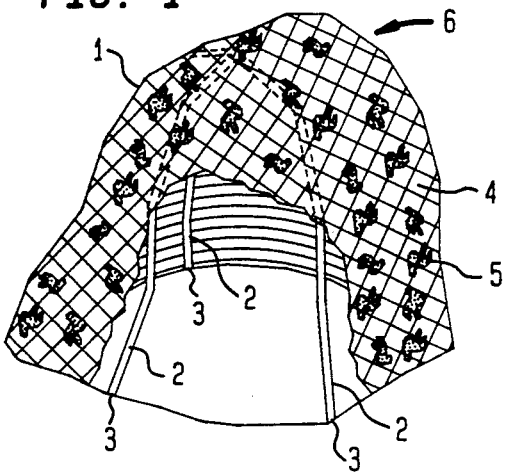
FIG. 1 is a schematic, partly broken away, perspective illustration of one embodiment of a camouflage device in accordance with the present invention.

Referring now to the drawing, and in particular to FIG. 1, there is shown a schematic, partly broken away, perspective illustration of one embodiment of a camouflage device in accordance with the present invention, generally designated by reference numeral 6. The frame of the camouflage device 6 includes at least three irregularly shaped rod structures 2, with their one ends being connected to each other in a common juncture 1, and with their other free ends 3 being placeable upon an object 7 (FIG. 2) to be camouflaged. A camouflage canvas or netting 4 is attached over the frame, and additional material 5 such as branches, twigs or the like is further affixed to the camouflage netting 4 for enhancing the camouflage effect.

Figure 2:
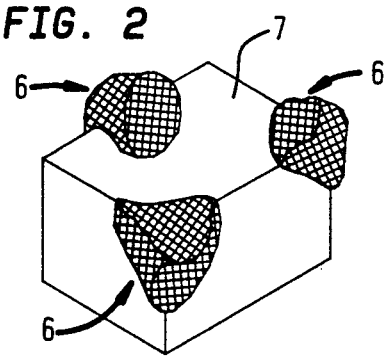
FIG. 2 is a schematic illustration of various camouflage devices suitably mounted to an exemplified object to be camouflaged.
Figure 3:
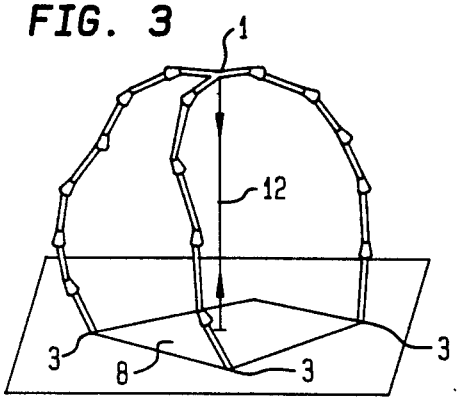
FIG. 3 is a schematic illustration of a camouflage device according to the invention, provided with a stiffening element for retaining the frame of the camouflage device according to the invention in place.

FIG. 2 illustrates an example of camouflaging an object 7 by using a plurality of camouflage devices 6. The object 7 is obscured by three camouflage devices 6 which are placed at selected areas of the object 7, for example at the corners or at a central area to give the object 7 an uneven appearance. In order to improve the hold of the frame upon the object 7, the free ends 3 of the rod structures 2 may be connected, as shown in FIG. 3, by a flexible backing 8 which may be a string structure of star-shaped or polygonal configuration, and/or by a flexible string 12 by which a tensile load is exerted in direction of the object 8.

Figure 4:
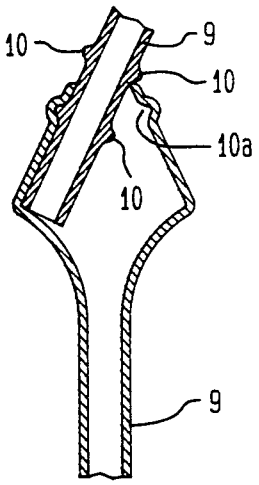
FIG. 4 is a schematic and fragmentary sectional view of exemplified rod segments suitably connected for forming the frame of the camouflage device.

Turning now to FIG. 4, there is shown a schematic and fragmentary sectional view of individual rod links or segments 9 which are joined or articulated to each other to create the rod structures 2 and to allow a random selection of irregular shapes of the frame. Each rod segment 9 is of elongated tubular configuration, with one extremity being expanded and approximately shaped in form of a diamond with open end and with the other extremity being provided with successively spaced pairs of semi-circular projections or bulges 10. At a suitable location, the diamond-shaped end of each rod segment 9 is provided with two opposing inside indentations 10*a* which are selectively engageable by either one of the projections 10 of another rod segment 9 to be attached. In this manner, the rod segments 2 to be attached can be moved back and forth in form of a flip-flop arrangement between two end positions to provide the rod structures 2 with irregular configuration.

Suitably, the diamond-shaped end of the rod segments 9 and the distance between the pairs of projections 10 are dimensioned in such a manner that upon connection of two rod segments 9 through engagement of a projection 10 in the corresponding indentation 10*a*, one projection of the upper pair of one rod segment 9 is supported by the open end of the other rod segment 9. Thus, the rod segments 9 are linked to each other in a tight and form-locking manner.

Figure 5:
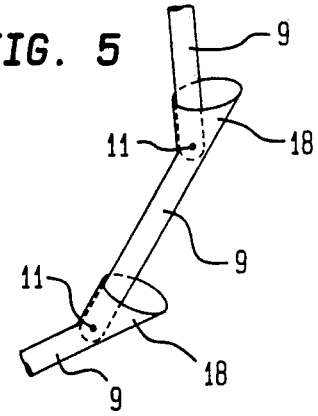
FIG. 5 is a schematic and fragmentary illustration of a variation of a hinged connection of exemplified rod segments of a camouflage device according to the invention.

FIG. 5 shows a schematic illustration of another example of a flip-flop connection of individual rod segments 9, and it can be seen that each rod segment 9 has one funnel-shaped end 18 to which the other end of a further rod segment 9 is suitably articulated so as to allow a relative rotational motion between the rod segments 9 about an axis of rotation 11. Suitably, each rod segment 9 extends slantingly from the funnel-shaped end 18 so that the axes of rotation 11 of successively linked rod segments 9 are offset relative to each other to allow different positioning of the rod segments 9 and to obtain an overall irregular shape of the camouflage device 6 when attaching a netting 4 thereto.

Persons skilled in the arts will understand that the individual rod segments 9 can be attached and held together by other means as well, for example by an elastic rubber band which is attached to the inside surface of the rod segments 9. Moreover, the individual rod segments may be made of suitably elastic or flexible material to allow deformation of each rod segment 9 to further increase the irregular appearance of rod structures 2.

Figure 6:
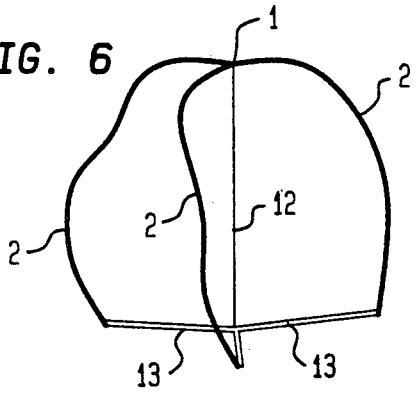
FIG. 6 is a schematic view of a frame of a camouflage device according to the invention, provided with an exemplified stretcher means for allowing upward folding of the camouflage device.

Turning now to FIG. 6, there is shown a frame of rod structures 2 which is stiffened or made firmer by the elastic band or string 12 in order to improve the stability of the camouflage device 6. As set forth with reference to FIG. 3, the string 12 has one end attached to the common juncture 1 in which the rod structures 2 meet with their one ends, and extends toward the object 7 (not shown in FIG. 6) to exert a tensile load in direction of the object 7. In this manner, the camouflage device 6 is securely held in place upon the object 7. The free ends 3 of the rod structures 2 are further connected by a suitable stretcher device in form of star-shaped struts 13 to allow folding and unfolding of the frame. Certainly, more complex strutting elements may be utilized, such as those used in umbrellas.

Figure 7:
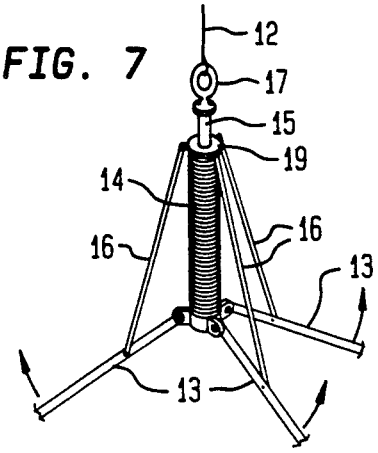
FIG. 7 is a schematic illustration of a spring-loaded mechanism for automatic folding and unfolding of a camouflage device according to the invention.

A typical example of an automatic stretcher device is shown in FIG. 7 which depicts an exemplary spring-loaded mechanism for automatic folding and unfolding of the struts 13 of the camouflage device 6 according to the invention. This mechanism includes a rigid guide bar 15 upon which an annular slide 19 slides. Hingedly connected to the slide 19 are the one ends of the struts 16, the other ends of which being respectively hinged to a central location of the struts 13. A compression spring 14 is mounted along the guide bar 15 between the slide 19 and the connection to the struts 13.

The upper end of the guide bar 15 may be provided with an eyelet 17 for attachment of the elastic band 12 to exert a tensile load.

What is claimed as new and desired to be protected by Letters Patent is set forth in the appended claims:

1. A camouflage device adapted to fold and unfold and to assume the shape of a dummy object when in the unfolded configuration for camouflaging an object, comprising a frame for supporting a camouflage netting, said frame being adaptable for displaying irregular configuration and including rod structures having first ends flexibly connectable with each other and other free ends adapted for secure placement upon a suitable location of the object to be camouflaged, each of said rod structures comprising individual rod segments said segments being articulated to each other in much a way as to allow multiple load bearing joint configurations of said rod structures and each of said rod segments being made of deformable material to allow each of said rod segments to bend or deform to different shapes.

2. A camouflage device as defined in claim 1, and further comprising flexible connecting means attached to the free ends of said rod structures for enhancing placement of the frame upon the object to be camouflaged.

3. A camouflage device as defined in claim 2 wherein said flexible connecting means includes a string structure connected to the free ends of said rod structures.

4. A camouflage device as defined in claim 3 wherein said string structure is shaped in the form of a star.

5. A camouflage device as defined in claim 3 wherein said string structure is shaped in form of a polygon.

6. A camouflage device as defined in claim 1, and further comprising stiffening means mounted to said frame and exerting a tensile load in direction of the object to be camouflaged.

7. A camouflage device as defined in claim 6 wherein said stiffening means includes a string having one end connected to the frame and extending toward the object to be camouflaged to exert a tensile load in direction of the object.

8. A camouflage device as defined in claim 1, and further comprising foldable stretcher means attached to the free ends of said rod structures for allowing folding and unfolding of said frame.

9. A camouflage device as defined in claim 8 wherein said frame and said stretcher means are braced by additional flexible elements for stiffening said frame when unfolding the latter.

10. A camouflage device as defined in claim 8 wherein said foldable stretcher means are spring-loaded along a rigid guide bar for allowing an automatic unfolding of said stretcher means.

11. A camouflage device as defined in claim 1 wherein said camouflage netting is additionally arranged inside said frame.

12. A camouflage device as defined in claim 1 wherein said rod segments are connectable to each other such as to allow back and forth movement of said rod segments relative to each other between two end positions.

13. A camouflage device as defined in claim 12 wherein each rod segment has one end and another end which is of expanded width so as to allow insertion of said one end of another rod segment and to allow selective positioning of said other rod segment.

14. A camouflage device as defined in claim 13 wherein each of said rod segments is provided in longitudinal extension thereof with spaced outer projection, said expanded end of each rod segment including opposing inside indentations for allowing selective engagement with respective projections of another rod segment.

15. A camouflage device as defined in claim 13 wherein said other end of each rod segment is of generally diamond-shaped configuration.

16. A camouflage device as defined in claim 13 wherein said other end of each rod segment is of funnel-shaped configuration, with said one end of another rod segment being articulated thereto so as to be rotatable about an axis of rotation and selectively positionable in either of said end positions.

17. A camouflage device as defined in claim 16 wherein successively connected rod segments define axes of rotation which are offset to each other.

18. A camouflage device adapted to fold and unfold and to assume the shape of a dummy object when in the unfolded configuration for camouflaging an object, comprising a frame for supporting a camouflage netting, said frame being adaptable for displaying irregular configuration and including rod structures having first ends flexibly connectable with each other and other free ends adapted for secure placement upon a suitable location of the object to be camouflaged, each of said rod structures comprising individual rod segments connectable to each other so as to allow back and forth movement of said rod segments relative to each other. Each rod segment having a first end and a second end, said second end being of expanded width so as to allow insertion of a first end of another rod segment said expanded width allowing selective angular positioning of said rod segments one within the other.

19. A camouflage device as defined in claim 18 wherein each of said rod segments is provided in longitudinal extension thereof with spaced outer projections, said expanded end of each rod segment including opposing inside indentations for allowing selective engagement with respective projections of another rod segment.

20. A camouflage device as defined in claim 18 wherein said other end of each rod segment is of generally diamond-shaped configuration.

* * * * *